United States Patent [19]

Hommes et al.

[11] 4,261,391

[45] Apr. 14, 1981

[54] APPARATUS FOR SEPARATING DOUBLE PLUSH CLOTH WEBS

[75] Inventors: Willi Hommes; Peter Mevissen; Peter Terporten, all of Nettetal, Fed. Rep. of Germany

[73] Assignee: Girmes-Werke AG, Grefrath, Fed. Rep. of Germany

[21] Appl. No.: 9,030

[22] Filed: Feb. 2, 1979

Related U.S. Application Data

[63] Continuation-in-part of Ser. No. 864,807, Dec. 27, 1977, abandoned.

[30] Foreign Application Priority Data

Dec. 27, 1976 [DE] Fed. Rep. of Germany ..... 2659097

[51] Int. Cl.[3] ..... D03D 39/18

[52] U.S. Cl. ..... 139/21; 26/14; 139/291 C

[58] Field of Search ..... 26/13, 14; 139/291 C, 139/21

[56] References Cited

U.S. PATENT DOCUMENTS

| | | | |
|---|---|---|---|
| 263,417 | 8/1882 | Lister et al. | 26/14 |
| 334,947 | 1/1886 | Garratt | 26/14 |
| 350,726 | 10/1886 | Drown | 26/13 |
| 593,957 | 11/1897 | Burt | 26/14 |
| 655,674 | 8/1900 | Fischer et al. | 26/14 |
| 768,348 | 8/1904 | Smith | 26/13 |
| 1,520,274 | 12/1924 | Benoit | 26/14 X |
| 2,754,564 | 7/1956 | Greenwood | 26/14 |
| 3,972,254 | 8/1976 | Dillinger et al. | 26/13 X |

FOREIGN PATENT DOCUMENTS

| | | | |
|---|---|---|---|
| 2522678 | 12/1976 | Fed. Rep. of Germany | 139/291 C |
| 7662 | | United Kingdom | 26/13 |
| 7417 | | United Kingdom | 26/14 |
| 18610 | | United Kingdom | 26/14 |
| 494457 | 3/1976 | U.S.S.R. | 26/14 |

*Primary Examiner*—Robert Mackey

*Attorney, Agent, or Firm*—Schwartz, Jeffery, Schwaab, Mack, Blumenthal & Koch

[57] ABSTRACT

Apparatus for separating a cloth web, produced in a double plush weaving machine, into two pile cloth webs. Cutters move transversely of the cloth web in adaptation to the beating strokes of the reed of the weaving machine, with the cutters being arranged at fixed distances from one another on an endless holder running over non-displaceably mounted lateral reversing rollers. The cutters are guided in the cutting plane by a stationary guide.

3 Claims, 3 Drawing Figures

APPARATUS FOR SEPARATING DOUBLE PLUSH CLOTH WEBS

REFERENCE TO RELATED APPLICATION

The present application is a continuation in-part of Ser. No. 864,807, filed Dec. 27, 1977, now abandoned.

BACKGROUND OF THE INVENTION

This invention relates to an apparatus for separating a cloth web produced in a double-plush weaving machine into two pile-cloth webs.

The separation of a cloth web produced in a double-plush weaving machine into two separate pile-cloth webs takes place with reciprocating cutters which move to and fro on a cutter table by means of a dovetail guide. The cutters are driven by a draw cable which itself is driven by means of a reciprocable drive from the main drive of the weaving machine, the drive to the cutters being such that cutting does not occur during the beating strokes of the reed of the associated weaving machine. This cutting apparatus has the disadvantage that it is not satisfactory for use with high-speed weaving machines, as wear occurs relatively quickly and the entire dovetail guide becomes unstable after only a relatively short period of operation.

In order to overcome this disadvantage, a known apparatus includes a belt-type cutter, that is to say an endless blade which is driven by two end rollers and which is provided with a guide in the cutting plane. Since cutting must not be effected during each beating stroke of the reed, such apparatus must repeatedly be tilted out of the position of engagement in order to guarantee an intermittent cut. This tilting is permitted by pivotably mounting the entire cutting apparatus for tilting back a few millimeters with every beating stroke of the reed. A disadvantage of this apparatus is that the guide of the cutter belt vibrates during cutting so that a very unsteady and irregular cut occurs. For reasons of design, it is not possible to construct the guide sufficiently compactly to prevent vibrations. A further disadvantage is that the entire mass of the cutter apparatus must be tilted back at each beating stroke of the weaving reed, and then tilted forward again into the cutting position.

The present invention provides an apparatus for separating the cloth web produced in a double-plush weaving maching into two pile cloth webs, with the apparatus having few movable parts and providing vibrationless guidance for the cutters even following long periods of operation.

SUMMARY OF THE INVENTION

The present invention provides apparatus for separating a cloth web, produced in a double-plush weaving machine, into two pile cloth webs, the apparatus being provided with cutting means movable transversely of the cloth web, wherein the cutting means is arranged on an endless holder which runs over non-displaceably mounted end rollers, and wherein the cutting means is guided in the cutting plane by a stationary guide.

Thus, a non-displaceable cutter mechanism is provided which is of compact construction and provided with a non-displaceable guide which can be constructed so that it is not set in vibration. This cutter apparatus comprises, for example, a belt cutter which is composed of only a few cutting parts or cutting blades over its entire length. This belt runs in synchronism with the weaving machine in such a way that cutting is effected only outside the beating stroke of the reed.

For driving the cutters, the belt drivably engages at least one of the rollers, for example by protrusions situated on the rollers and corresponding holes in the belt. However, other endless carriers such as, for example, a chain or a cable, can serve as a holder for the cutters.

The working speed of the weaving machine and the width of the machine available for the installation of the cutting mechanism determine the number of the possible individual blades or cutting parts on the holder. The holder can be provided with attached blades or, if it is a steel belt, can comprise blades or cutting parts protruding from and integral therewith.

The cutting apparatus preferably runs in synchronism with a double-plush weaving machine so that cutting is effected only outside the beating stroke of the reed, and therefore a steady cut is possible. Moreover, it is apparent that this cutting apparatus can be non-displaceably fitted, and thus a straight and precise guidance of the blades in the entire cutting zone is possible, that is to say, the guide elements can be arranged above, behind, beside and/or below the holder for the blades, which elements are of such compact and stable formation that the cutters are guided without vibration and correspondingly generate a straight and regular cut over the width and the length of the cloth web.

BRIEF DESCRIPTION OF THE DRAWINGS

One form of cutting apparatus constructed in accordance with the invention will now be described by way of example, with reference to the accompanying drawings, in which.

DETAILED DESCRIPTION OF PREFERRED EMBODIMENT

Figure 1:
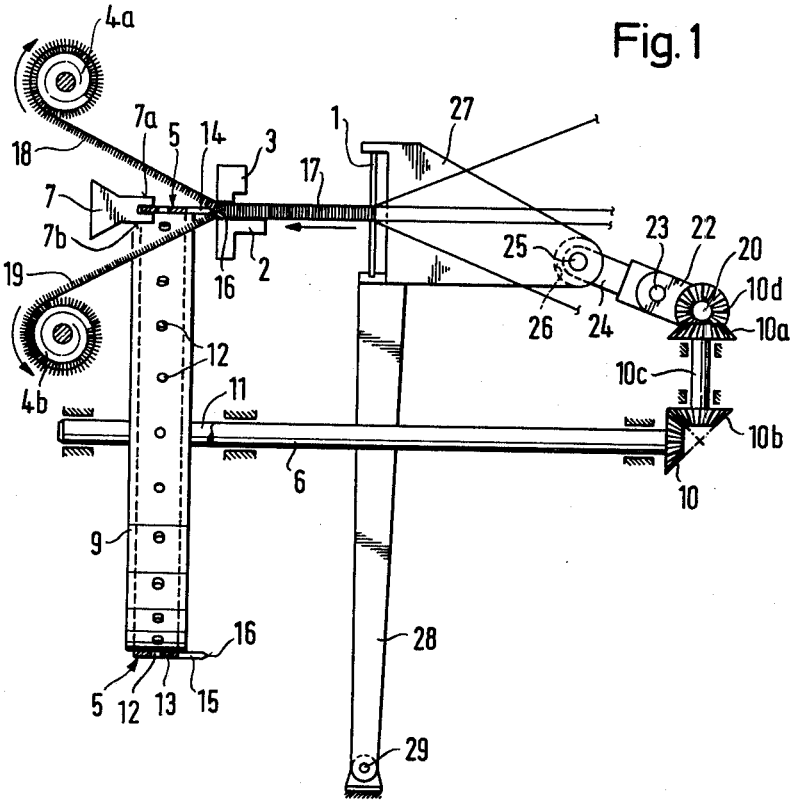
FIG. 1 is a partially schematic side elevational view of the cutting apparatus installed in a double-plush weaving machine, partially sectioned.

Referring to the drawings, the cutting apparatus is shown in conjunction with a double-plush weaving machine which is shown only diagrammatically. The double-plush weaving machine has a reed 1 which is shown during its beating stroke, a cutter table 2, a ruler 3, and two cloth take-up cylinders 4*a* and 4*b*, with all of these members being shown essentially diagrammatically.

Figure 2:
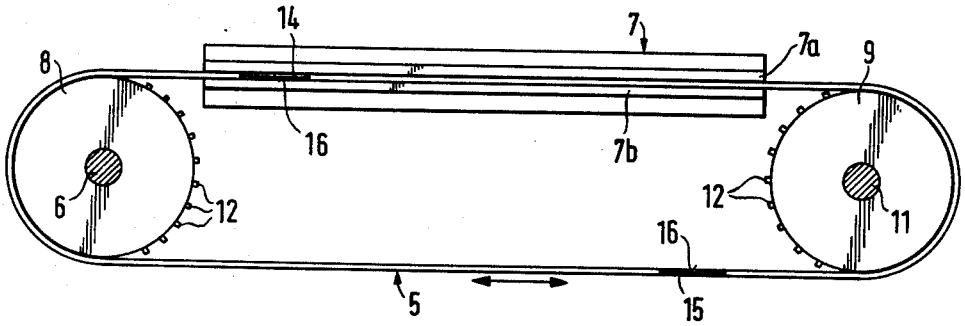
FIG. 2 is a front elevation of the cutting apparatus of FIG. 1.

The cutting apparatus consist of an endless belt 5 of steel which runs over two end rollers 8 and 9 (FIG. 2). The roller 8 is mounted on a shaft 6 which is provided with a drive pinion 10 which can be driven from the main drive (not shown) of the weaving machine. The roller 9 is mounted freely rotatably on a shaft 11 and accordingly accompanies the movement of the roller 8.

The rollers 8 and 9 have protrusions such as pegs or teeth 12 on their periphery which engage in correspondingly shaped holes 13 in the belt 5, so that a positive drive connection exists between the belt and the rollers.

Two protrusions 14 and 15 formed as cutting elements or blades, and each having a sharpened front edge 16 (see FIG. 1), are arranged at a fixed distance from one another on the front edge of the belt 5. These cutting elements 14 and 15 cut a double-plush cloth web 17 into two separate pile cloth webs 18 and 19 which run to the cloth take-up rollers 4*a* and 4*b* (see FIG 1). The cutting elements 14 and 15 are arranged to cut the web 17 only when the reed 1 is not executing a beating stroke. In FIG. 1, the reed 1 is shown executing a beating stroke and the cutting element 14 is shown cutting, but this is only for the purpose of illustrating these formations in a single figure.

In its upper (cutting) run, the belt 5 is guided by means of a stationary rectilinear guide 7. The guide 7 has two parallel flanges 7*a* and 7*b* which grip loosely therebetween the rear edge of the belt 5 so as to prevent vibration of the belt in the cutting zone. As can be seen clearly from the drawings, the guide 7 can be made very compact and stable in order to reliably preclude vibration of the belt.

Figure 3:
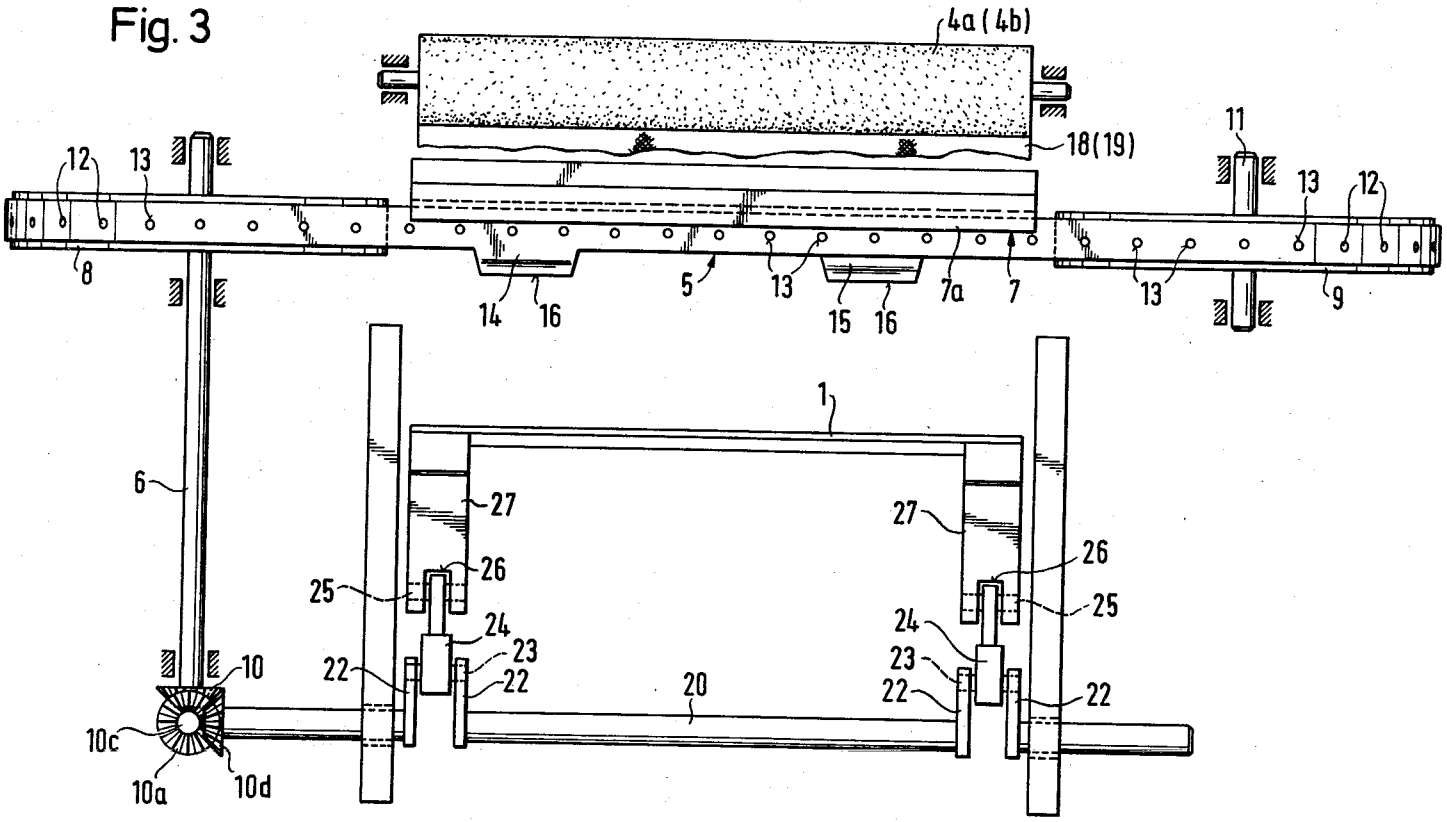
FIG. 3 is a partially schematic top plan view of the cutting apparatus of FIG. 1.

Reference is now made to the drive means for the rollers 8 and 9, and the reed 1. As above noted, it is a desired objective of the invention to effect cutting of the double-plush web outside the beating stroke of the reed thereby to provide a steady cut. Referring to FIGS. 1 and 3, the drive pinion 10 for the shaft 6 operatively engages a bevel gear 10*b* which is connected by stub shaft 10*c* to a second bevel gear 10*a* . The latter engages a bevel gear 10*d* secured to the end of crank shaft 20. The latter is formed of three sections as shown, with the crank arms, commonly indicated at 22, being spaced and receiving therebetween a crank pin 23 on which crank members 24 are mounted. The opposite ends of the crank members 24 are similarly received around pins 25 formed in opening 26 in reed arms 27, with the reed 1 being secured to the reed arms 27. It will be understood that all of the shafts above described are supported in bearing mounts which are shown in these figures but not referred to by a particular reference numeral.

It will thus be seen that as the crank shaft 20 is rotated, by drive means not shown, the shaft 6 is continually rotated, which in turn rotates the roller 8 and thus the belt 5. Through the described crank shaft arrangement, the reed 1 is reciprocated (upwardly and downwardly as viewed in FIG. 3), with the upward or beating stroke of the reed occurring when the cutters 14 and 15 are not engaging the double-plush cloth web. Although in FIG. 3 it appears that the cutters 14 and 15 are in the same plane, it will be noted that in FIG. 2 they are spaced approximately equidistantly apart on the belt 5 so that during each beating stroke of the reed, the cutters 14 and 15 are out of contact with the web.

The described synchronism between the reciprocation of the reed and the cutting of the double-plush web eliminates the need for tilting or otherwise moving the cutting apparatus away from the plane of the web, as in prior art apparatuses. The present invention accomplishes the synchronism in a very simple matter and with relatively few moveable parts. In addition, the guiding of the belt through the flanges 7*a* and 7*b* of the guide 7 prevents vibration of the belt in the cutting zone.

As shown in FIG. 1, reed 1 is supported on levers 28 which are tiltable around pins 29, which pins are fixed to the frame of the weaving machine (not shown).

We claim:

1. Apparatus for separating a cloth web, produced in a double-plush weaving machine having a reed, into two pile cloth webs, comprising (a) an endless belt, (b) roller means around which said endless belt travels, and drive means for at least one of said rollers, said drive means including a series of recesses formed in said belt and a plurality of prongs formed on the periphery of at least one of said rollers and extending into said recesses, (c) at least two cutting elements positioned on said endless belt at a fixed distance from one another so as to sequentially cut the double plush web, said cutting elements comprising protrusions situated on the forward edge of said belt, (d) stationary guide means positioned in the cutting plane, said guide means including a pair of parallel flanges which define a guide slot, said flanges loosely gripping the opposite sides of said belt to provide substantially vibrationless guidance for said cutting elements while in the cutting area, and (e) means for synchronizing the driving of said roller means with the reed of the weaving machine, said synchronizing means comprising a first shaft for said roller means, a second shaft disposed generally perpendicular to said first shaft, a crank shaft directly operably engaging said second shaft, gear means drivingly connecting said first shaft, said second shaft and said crankshaft, and arm means interconnecting said reed and said crankshaft, whereby said reed is reciprocated by said arms to and from a beating position, said cutting elements carried by said belt being in a cutting position only between beating strokes of said reed whereby a steady cut can be made by said cutting elements while the same move vibrationless through said flanges of said guide means.

2. Apparatus for separating a cloth web, produced in a double-plush weaving machine having a reed, into two pile cloth webs, comprising (a) a holder in the form of an endless belt, said belt being provided with a series of recesses, (b) roller means around which said endless belt travels, said roller means being formed with prongs which extend into said recesses in said belt, and drive means for at least one of said rollers, (c) at least two cutting elements positioned on said endless belt at a fixed distance from one another so as to sequentially cut the double plush web, said cutting elements comprising protrusions situated on the forward edge of the belt, (d) stationary guide means positioned in the cutting plane, said guide means including a pair of parallel flanges which define a guide slot, said flanges loosely gripping the opposite sides of said belt to provide substantially vibrationless guidance for said cutting elements while in the cutting area, (e) a reed, and means for mounting the same, and (f) means for synchronizing the driving of said roller means with the reed of the weaving machine, said synchronizing means comprising drive means directly interconnecting the mounting means for said reed and the drive means for said at least one roller, whereby cutting is effected only between beating strokes of the reed so that a steady cut can be made by said cutters moving vibrationless through said flanges of said guide means.

3. The apparatus of claim 2 wherein said drive means directly interconnecting said drive means for at least one of said rollers and said mounting means for said reed comprises a first shaft for said roller means, operably engaged bevel gear means mounted on said first shaft and on a second shaft disposed generally perpendicularly to said first shaft, said second shaft directly operably engaging a crank shaft through a further series of bevel gears, and arm means reciprocatably driven by said crank shaft, said reed being secured to said arm means, the synchronous drive being such that said reed is moved to a beating position at the time said cutting elements are out of engagement with said web.

* * * * *